US009795870B2

(12) United States Patent
Ratliff

(10) Patent No.: US 9,795,870 B2
(45) Date of Patent: Oct. 24, 2017

(54) GAMING CHIP TRAY COUNTING DEVICE

(76) Inventor: Darrell Smith Ratliff, Castle Rock, CO (US)

( * ) Notice: Subject to any disclaimer, the term of this patent is extended or adjusted under 35 U.S.C. 154(b) by 291 days.

(21) Appl. No.: 12/563,142

(22) Filed: Sep. 20, 2009

(65) Prior Publication Data

US 2011/0070943 A1 Mar. 24, 2011

(51) Int. Cl.
*A63F 13/00* (2014.01)
*A63F 11/00* (2006.01)

(52) U.S. Cl.
CPC ..... *A63F 11/0002* (2013.01)

(58) Field of Classification Search
USPC ..... 463/25
See application file for complete search history.

(56) References Cited

U.S. PATENT DOCUMENTS 4,667,093 A * 5/1987 MacDonald ..... 250/223 R
5,451,054 A * 9/1995 Orenstein ..... 273/148 R
5,757,876 A * 5/1998 Dam ..... G06M 1/101 377/14
6,200,218 B1 * 3/2001 Lindsay ..... 463/25
6,848,994 B1 * 2/2005 Knust et al. ..... 463/25
2003/0096645 A1 * 5/2003 Soltys et al. ..... 463/25
2005/0150740 A1 * 7/2005 Finkenzeller et al. ..... 194/207
2006/0019739 A1 * 1/2006 Soltys et al. ..... 463/25
2006/0068878 A1 * 3/2006 Krenn ..... G07F 17/32 463/17
2007/0176349 A1 * 8/2007 Gerlier et al. ..... 271/10.03
2009/0233699 A1 * 9/2009 Koyama ..... 463/25
2010/0210350 A9 * 8/2010 Walker et al. ..... 463/25

* cited by examiner

*Primary Examiner* — Jason Yen

(57) ABSTRACT

A Gaming Chip/Poker Chip Tray includes a laser-type distance measuring device that measures the quantity of gaming poker chips located in each tray. As the device reads the quantity of chips per tray, the information is relayed to a processor which can display the added quantity in real-time. A microprocessor can control the laser reading device, and display. The real-time quantity can be displayed visibly with a digital display device or through a wired or wireless CPU device located on or away from the table containing the Counting Device.

6 Claims, 1 Drawing Sheet

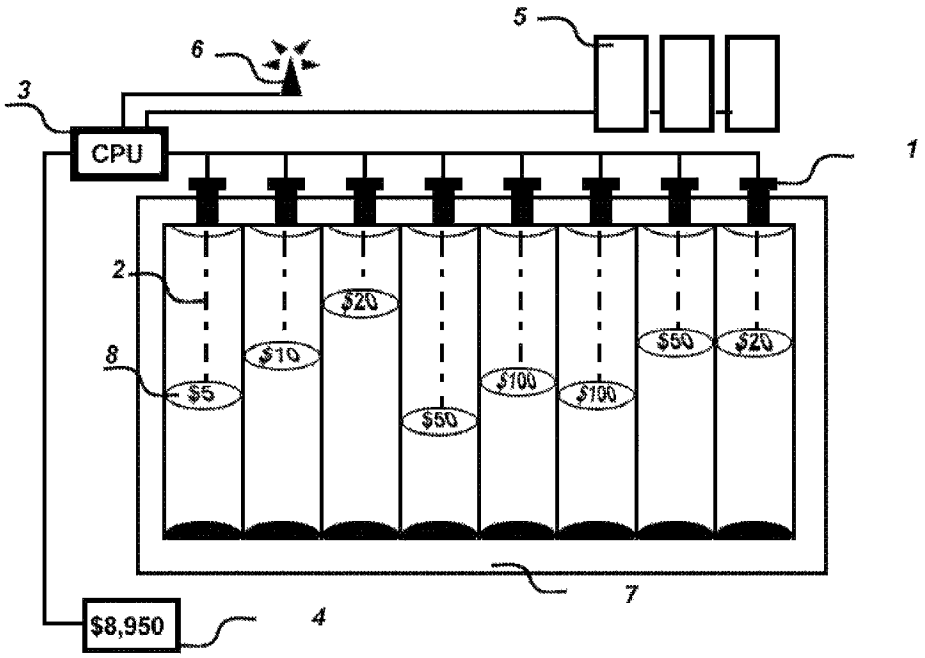
1
5
6
CPU
3
2
8
$20
$50
$100
$100
$50
$20
$10
$5
7
4
$8,950

GAMING CHIP TRAY COUNTING DEVICE

BACKGROUND OF THE INVENTION

This invention relates to electronic distance measuring equipment linked together for creating a sum total of contents located in a gaming/poker chip tray or case and more particularly, a method for a Casino or Gaming Establishment to monitor play results live or in "real-time" or quickly and precisely inventory Gaming chips.

A variety of technologies are available for remotely determining the distance from a source to an object. Generally, these approaches involve emitting some type of energy toward the object (such as a laser) and receiving a portion of the energy reflected back from the object or a reflective target (such as a corner-curb prism) placed at the object.

The distance from the source to the object is determined by one of several approaches. This device uses one of those technologies as a component connected to a gaming/poker chip holding tray or a gaming table where a tray can be easily removed and is programmed to create a sum total of the amount of "chips" located in the tray. The trays can be removed from the table leaving the equipment remaining built into the gaming table as well.

There is a need for such a device, that is accurate in the measured distance, requires no reflective target up to intermediate distances, is extremely accurate, has a low power requirement, and is not dangerous to the operator or other persons in the area where such device would be used. This present invention fulfills this need, and further provides related advantages as outlined below.

BRIEF SUMMARY OF THE INVENTION

The present invention provides a light-based distance measuring device. In a preferred embodiment the device operates mounted to a Gaming/Poker Chip style tray. The device has multiple extremely accurate distance measuring devices based on the size of the tray and amount of holding columns within the tray or case. This measuring device provides a constant total sum of the amount of chips located in the tray in real-time. As game play in action and chips are removed or added, the sum total of the amount located within the case/tray changes. This information is then sent to a display location which can be done by several approaches including a visible display on each table, at a desired location within the gaming area, through a network of computers or other Gaming Chip Tray Counting Devices and can be linked together to give management a real-time picture of how the casino or other gambling establishment is doing in winnings or losses at any given moment. This information could also be transmitted wirelessly and worldwide through the internet if desired.

The present invention provides an important advance in the management of gaming. Gaming establishments can quickly identify individual tables where aggressive cheating may be taking place. This technology would also help prevent game play interruption for "table count" in which the play is stopped for a manual table count. The casino or gaming establishment can also immediately react to unusual activities located at any table where this invention is being used and respond quickly to determine the problem before large losses are incurred.

The device of the invention is a practically useful, portable instrument for accurate measurements of money or the equivalent in gaming chips. Other features and advantages of the invention will be apparent from the following more detailed description of the invention, taken in conjunction with the accompanying drawing, which illustrates, by way of example, the advantages of the invention.

BRIEF DESCRIPTION OF THE DRAWINGS

The FIGURE is a schematic drawing depicting a preferred embodiment of the present invention.

DETAILED DESCRIPTION OF THE INVENTION

In accordance with a preferred embodiment of the invention, the Gaming Chip Tray Counting Device utilizes mounted laser-type distance measuring devices 1 that emit a laser beam 2 or other distance measuring method from the top of the tray 7 through an opening to the closest gaming/poker chip 8 in each slot or tray stack of tray 7 and based on the distance from the reader 1 to the chip 8, calculates the distance to determine the quantity of chips 8 in each column or stack. Each device is programmable to a unique monetary denomination for sum total calculations. The results of each calculation is then sent to the CPU 3 where the totals of each are continuously added together to reach an ongoing total sum in real-time and sent to a display 4 or other optional information distribution method such as wirelessly using wireless device 6 or linked and networked through a series of CPU devices 5.

A microprocessor (not shown) controls the laser drivers and stores the counts determined by a counter (not shown). This calculation approach is preferred. Other procedures may be used as appropriate.

Reader 1 is available in several different designs in the marketplace. A variety of technologies are available for remotely determining the distance from a source to an object.

The present invention therefore provides an approach to precisely calculating a sum total of Gaming/Poker Chips in real-time within a tray 7 or holding device. Although particular embodiments of the invention have been described in detail for purposes of illustration, various modifications may be made without departing from the spirit and scope of the invention. Accordingly, the invention is not to be limited except as by the appended claims.

What is claimed is:

1. A poker chip tray counting device comprising: a plurality of rows for receiving a plurality of poker chips within; and b) a reader positioned at an upper end of each of the plurality of rows of the poker chip tray, wherein each reader is operable to emit a signal toward the poker chips in the corresponding row of the poker chip tray whereby a number of chips in each row of the poker chip may be is determined in real time based on a distance traveled by the signal between the reader and the chips in each row of the poker chip tray, wherein the reader comprises a laser.

2. The Poker Chip Tray Counting Device of claim 1, further comprising a poker chip tray CPU in communication with each of the readers in each of the plurality of rows of the poker chip tray, wherein the poker chip CPU associates each row of the poker chip tray with a chip value for chips stacked in each row of the poker chip tray.

3. The Poker Chip Tray Counting Device of claim 2, further comprising a display device in communication with the poker chip tray CPU configured to display a total value of all of the poker chips in each of the rows of the poker chip tray in real time.

4. The Poker Chip Tray Counting Device of claim 2, further comprising a wireless transmitter in communication with the poker chip tray CPU and configured to transmit a total value of all of the poker chips in each of the rows of the poker chip tray in real time.

5. The Poker Chip Tray Counting Device of claim 2, further comprising a plurality of remote CPUs in communication with the poker chip tray CPU.

6. The Poker Chip Tray Counting Device of claim 2, further comprising a microprocessor in communication with each reader and configured to store the count of chips within each row of the poker chip tray associated with each reader in a counter.

* * * * *